US005862645A

United States Patent [19]

Lee

[11] Patent Number: 5,862,645

[45] Date of Patent: Jan. 26, 1999

[54] BURGLARPROOF SASH WINDOW

[76] Inventor: Ming Kun Lee, 2/F., No. 13, Hsing-Nan St., Nan-Kang Dist., Taipei-City, Taiwan

[21] Appl. No.: 880,654

[22] Filed: Jun. 23, 1997

[51] Int. Cl.[6] ..... E04C 2/54

[52] U.S. Cl. ..... 52/786.11; 52/656.8; 49/61; 49/501

[58] Field of Search ..... 52/786.11, 656.8, 52/786.1, 204.61, 204.62; 49/449, 501, 61, 62; 292/DIG. 46, DIG. 47; 160/90, 104; 70/97, 89, 100, 2.3, 90

[56] References Cited

U.S. PATENT DOCUMENTS

| | | | |
|---|---|---|---|
| 3,555,735 | 1/1971 | Weikert | 49/501 |
| 4,653,797 | 3/1987 | Tran | 49/62 X |
| 4,791,762 | 12/1988 | Hwang | 52/171.1 |
| 4,972,639 | 11/1990 | Woznick | 49/62 X |
| 5,221,363 | 6/1993 | Gillard | 52/173.3 X |
| 5,226,919 | 7/1993 | Milligan | 52/314 |
| 5,251,417 | 10/1993 | Yates | 52/456 |
| 5,319,879 | 6/1994 | Rozycki | 49/61 |
| 5,428,924 | 7/1995 | Pifer | 49/50 |
| 5,575,321 | 11/1996 | Currier | 52/207 |

*Primary Examiner*—Carl D. Friedman
*Assistant Examiner*—Beth Aubrey
*Attorney, Agent, or Firm*—Rosenberg, Klein & Bilker

[57] ABSTRACT

A sash window includes two sashes locked with a combination lock, each sash having a metal inner frame sandwiched in between two glass plates within a rectangular frame, the metal inner frame having intersected metal bars mounted on the inside that prohibit burglars from breaking in.

1 Claim, 3 Drawing Sheets

BURGLARPROOF SASH WINDOW

BACKGROUND OF THE INVENTION

The present invention relates to burglarproof sash windows, and more specifically to a sash for a sash window which has a metal inner frame with intersected metal bars on the inside that prohibit burglars from breaking in.

A regular sash window 2, as shown in FIG. 3, comprises two sashes 21 holding a respective window glass 22, and a snap 23 mounted on one sash 21 and controlled to engage a locating groove 231 on the other sash 21, permitting the sashes 21 to be locked. This structure of sash window 2 is not safe in use because the window glass 22 cannot stop a burglar from breaking in. If to protect against burglars, a metal window shall be mounted on the outside wall over the sash window. However, the installation of a metal window on the outside wall of a building destroys the sense of beauty of the outer appearance of the building.

SUMMARY OF THE INVENTION

The present invention has been accomplished to provide a burglarproof sash window which eliminates the aforesaid problems. According to one aspect of the present invention each sash of the sash window comprises a metal inner frame sandwiched in between two glass plates within a rectangular frame, the metal inner frame having intersected metal bars mounted on the inside that prohibit burglars from breaking in. According to another aspect of the present invention, a combination lock is installed in one sash so that the user can lock the sash window without using a key.

DETAILED DESCRIPTION OF THE PREFERRED EMBODIMENT

Figure 1:
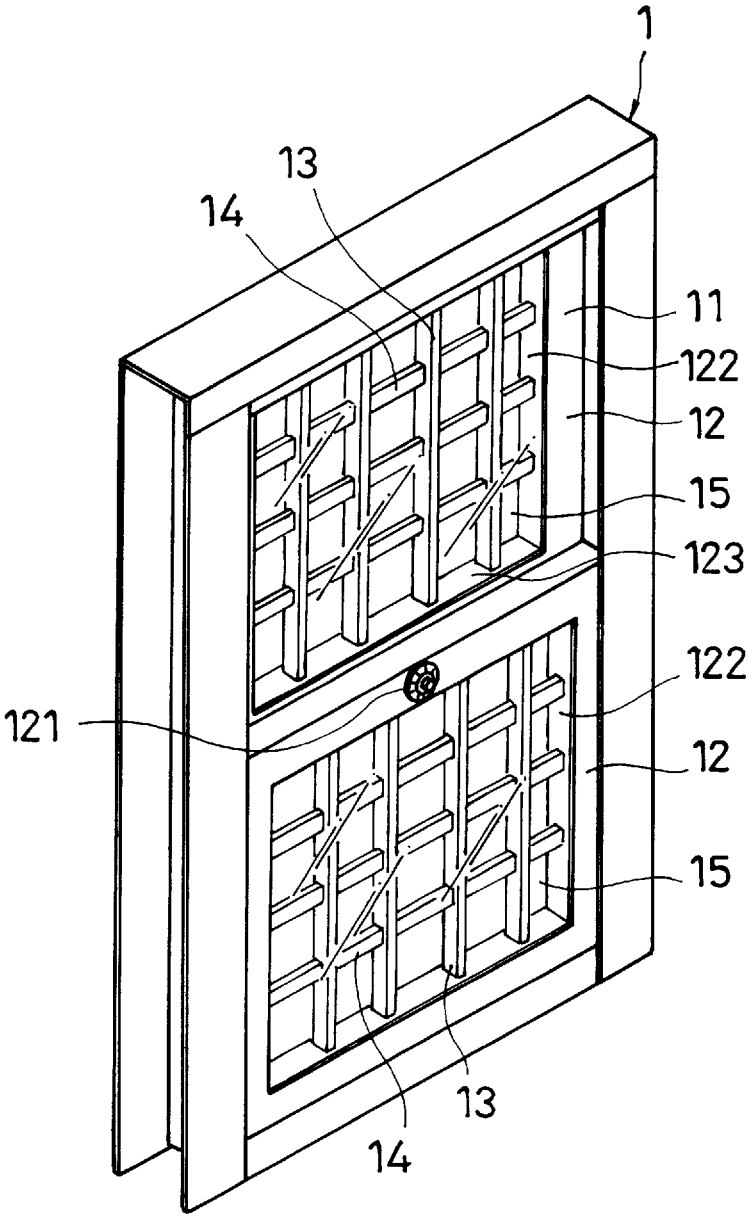
FIG. 1 is an elevational view of a sash window according to the present invention.
Figure 2:
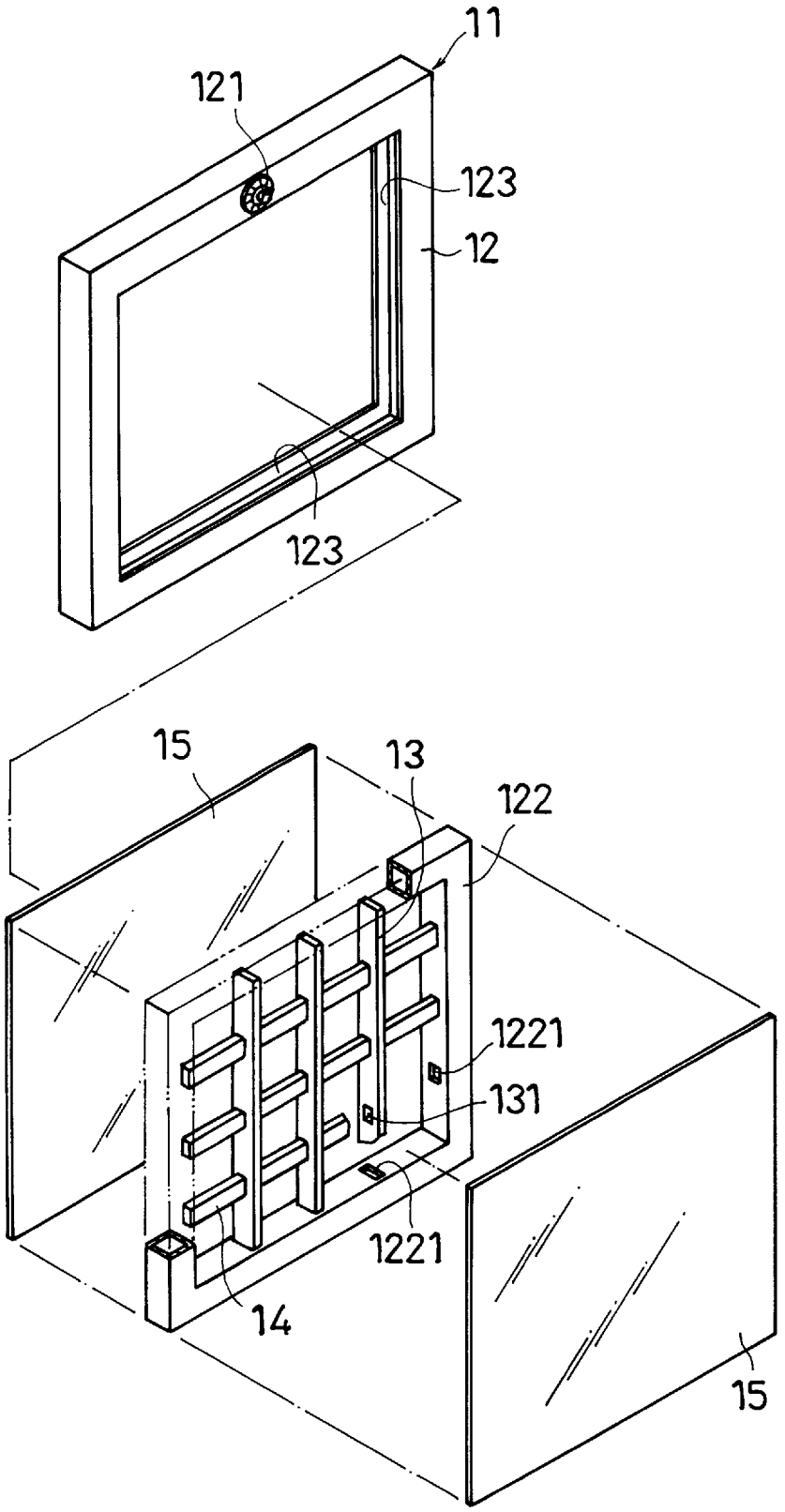
FIG. 2 is an exploded view of one sash of the sash window shown in FIG. 1.
Figure 3:
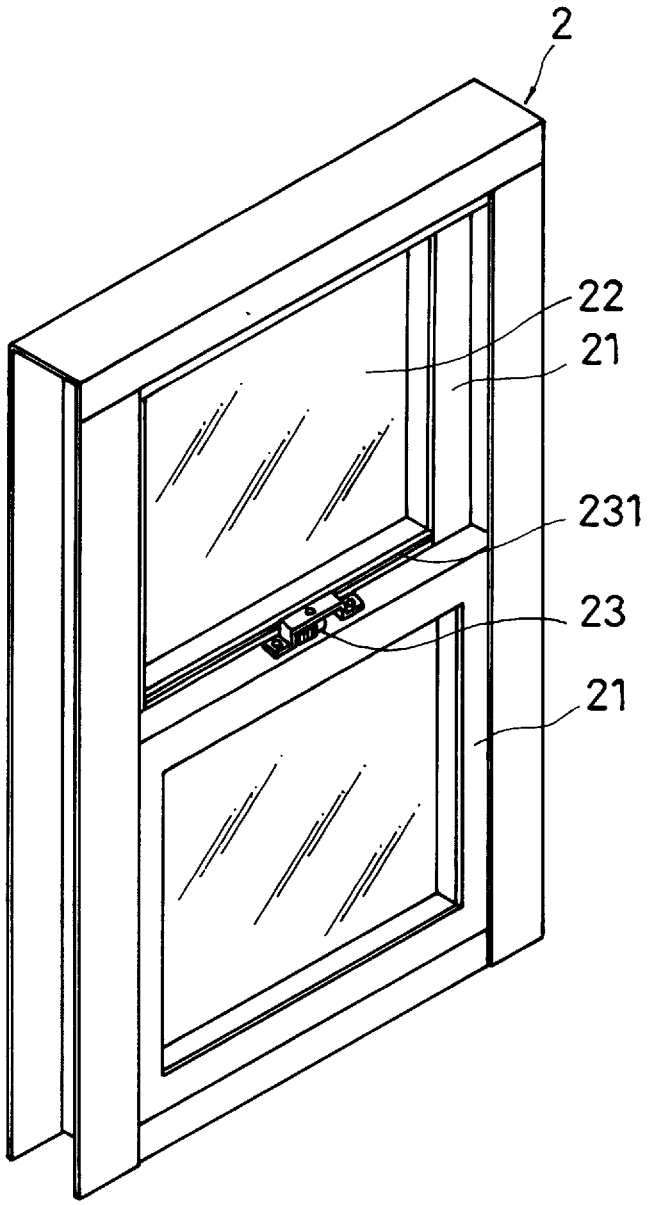
FIG.3 PRIOR ART
FIG. 3 is an elevational view of a sash window according to the prior art.

Referring to FIGS. 1 and 2, the burglarproof sash window, referenced by 1, is a double-hung window comprised of two sashes 11. Each sash 11 comprises a rectangular frame 12 having a mounting groove 123 around its inside wall, a metal inner frame 122 mounted in the mounting groove 123, and two glass plates 15 mounted in the rectangular frame at two opposite sides of the metal inner frame 122. The metal inner frame 122 is a rectangular frame having a plurality of plug holes 1221 spaced around its inside wall. A plurality of vertical metal bars 13 and a plurality of horizontal metal bars 14 are intersected with one another and respectively mounted in the plug holes 1221 within the metal inner frame 122. The vertical metal bars 13 have through holes 131 which receive the horizontal metal bars 14. Further, one sash 11 is mounted with a combination lock 121 for locking.

Because each sash 11 is protected by a metal inner frame 122 with vertical metal bars 13 and horizontal metal bars 14, the sash window 1 is so strong that burglars cannot break in.

While only one embodiment of the present invention has been shown and described, it will be understood that various modifications and changes could be made thereunto without departing from the spirit and scope of the invention disclosed.

What the invention claimed is:

1. A burglarproof sash window comprising two vertical sliding sashes, and a lock mounted on one of said sashes for locking, wherein each sash comprises a rectangular frame having a mounting groove around an inside wall thereof, a metal inner frame mounted in said mounting groove, and two window glasses mounted in said rectangular frame at two opposite sides of said metal inner frame, said metal inner frame comprising a plurality of plug holes spaced around an inside wall thereof, and a plurality of vertical metal bars and a plurality of horizontal metal bars intersected with one another and respectively mounted in said plug holes within said metal inner frame, said vertical metal bars having through holes which receive said horizontal metal bars; said lock is a combination lock.

* * * * *